US007614935B2

(12) United States Patent
Weiland

(10) Patent No.: US 7,614,935 B2
(45) Date of Patent: Nov. 10, 2009

(54) APPARATUS FOR MACHINING A WORKPIECE

(75) Inventor: Josef Weiland, Bad Wurzach (DE)

(73) Assignee: Lissmac Maschinebau und Diamantwerkzeuge GmbH, Bad Wurzach (DE)

( * ) Notice: Subject to any disclaimer, the term of this patent is extended or adjusted under 35 U.S.C. 154(b) by 0 days.

(21) Appl. No.: 12/037,427

(22) Filed: Feb. 26, 2008

(65) Prior Publication Data

US 2008/0207097 A1 Aug. 28, 2008

Related U.S. Application Data

(63) Continuation of application No. PCT/DE2006/001608, filed on Sep. 11, 2006.

(30) Foreign Application Priority Data

Sep. 12, 2005 (DE) ..... 20 2005 014 430 U

(51) Int. Cl.
*B24B 49/00* (2006.01)

(52) U.S. Cl. ..... 451/11; 451/297; 451/300; 451/302; 451/303; 451/309

(58) Field of Classification Search ..... 451/296, 451/297, 299, 300, 302, 303, 309, 311, 11
See application file for complete search history.

(56) References Cited

U.S. PATENT DOCUMENTS

| | | | | |
|---|---|---|---|---|
| 1,932,092 | A * | 10/1933 | Etchart | 451/300 |
| 3,686,798 | A * | 8/1972 | CoPresti | 451/300 |
| 3,859,757 | A * | 1/1975 | Heesemann | 451/300 |
| 4,837,984 | A * | 6/1989 | David | 451/57 |
| 4,930,259 | A * | 6/1990 | Kobylenski et al. | 451/303 |
| 5,193,317 | A * | 3/1993 | Nordquist et al. | 451/53 |
| 5,443,415 | A * | 8/1995 | Shebanow et al. | 451/302 |
| 6,001,004 | A * | 12/1999 | Botteghi | 451/168 |
| 6,299,517 | B1 * | 10/2001 | Weber | 451/309 |

FOREIGN PATENT DOCUMENTS

| | | | |
|---|---|---|---|
| EP | 0 187 624 | A2 | 7/1986 |
| EP | 0 444 242 | A1 | 9/1991 |
| EP | 0 571 343 | A1 | 11/1993 |
| EP | 1 088 636 | A2 | 4/2001 |
| EP | 1 215 010 | A2 | 6/2002 |
| WO | 93/23203 | A1 | 11/1993 |
| WO | 2004/039536 | A1 | 5/2004 |

* cited by examiner

*Primary Examiner*—Eileen P. Morgan
(74) *Attorney, Agent, or Firm*—Burr & Brown

(57) ABSTRACT

An apparatus for machining a strip- or plate-shaped metallic workpiece is proposed, in particular for the deburring of cut edges and/or for the grinding of surfaces of the workpiece, having at least one machining unit which has a revolving drive device which directs a machining element at least approximately linearly past the region of the workpiece to be machined obliquely or transversely to the feed direction of the workpiece. According to the invention, the machining element is designed as a grinding belt, the grinding belt, in the region of the workpiece to be machined, being in operative connection with the drive device in such a way that the drive device drives the grinding belt, and the grinding belt and the drive device are separate from one another at least in a region remote from the workpiece.

24 Claims, 4 Drawing Sheets

APPARATUS FOR MACHINING A WORKPIECE

CROSS REFERENCE TO RELATED APPLICATION

This application is a continuation of International Application No. PCT/DE2006/001608, having an international filing date of Sep. 11, 2006, and claims the benefit under 35 USC 119(a)-(d) of German Application No. 20 2005 014 430.4 filed Sep. 12, 2005, the entireties of which are incorporated herein by reference.

FIELD OF THE INVENTION

The invention relates to an apparatus for machining a strip- or plate-shaped metallic workpiece, in particular for the deburring of cut edges and/or for the grinding of surfaces of the workpiece.

BACKGROUND OF THE INVENTION

An apparatus of the generic type for machining a strip- or plate-shaped metallic workpiece is known from WO 2004/039536 A1.

During the laser cuffing, in particular also during the plasma cuffing, of metallic workpieces, burrs form at the cut edges, and these burrs have to be removed before the further machining of the workpiece, for example before the latter is enameled.

Furthermore, plate-shaped metallic workpieces often have on their surfaces or main surfaces discoloration, residues or the like, which have to be removed before further processing or finishing. This is intended to avoid a situation in which, for example, enameling or galvanizing to be applied comes off again relatively quickly. For this reason, the surfaces of the metallic workpieces are ground before the enameling or galvanizing.

Apparatuses for deburring and precision grinding are known from the general prior art. In this case, both rolls and plate-like, rotating brush tools are used. In the known apparatuses, the workpiece to be machined is placed on a horizontal working plane or a conveyor belt and is passed through under the roll or the rotating brush tool by hand or automatically. It is a disadvantage in this case that the workpieces as a rule are always pushed in at the same location, such that uneven wear of the roll or of the brush tools is affected. Such machines can have, for example, a working width of 1 to 2 m, but in practice are mostly furnished with smaller metal blanks. The result of this is that a roll having a length of, for example, 2 m is merely stressed over the first 50 cm of its length by metal blanks and therefore becomes worn only in this region. As soon as this region has worn down too far, the roll has to be replaced, although three quarters of the roll surface is still in good condition and is usable. For this reason alone, replacement cannot be avoided, since the first 50 cm of the roll no longer performs a grinding action when a large workpiece is introduced. The uneven wear of the roll and the resulting different pressure on the workpiece produce a grinding result of inferior quality.

In addition, a disadvantage with the known deburring and grinding machines is that the workpiece has to be inserted twice so that both main surfaces of the workpiece can be machined. A further disadvantage of the known machines is the high drive power, the large amount of space required and the high procurement and maintenance costs.

Furthermore, as shown in FIG. 1, revolving grinding belts which revolve against the feed direction of the workpiece to be ground are known from the general prior art. The grinding belts in this case have correspondingly large widths so that correspondingly wide workpieces can also be machined. In a similar manner to the known roll and brush tools, there is the disadvantage that the grinding belt becomes worn unevenly if the fed metal piece has a width which is less than the width of the grinding belt. As can be seen from FIG. 1, the grinding belt is oriented essentially vertically, the workpiece to be machined being pushed through below a narrow end face of the grinding belt. The grinding belt is driven by a drive shaft.

In addition to the fact that the wear of the grinding belts is uneven for the reasons already mentioned with regard to the aforesaid grinding machines, a further disadvantage consists in the fact that the grinding of plate- or strip-shaped workpieces having uneven surfaces varies sharply. It may be the case that only the arches are ground, whereas the grinding belt cannot penetrate into the recesses, as a result of which deposits, contaminants or the like cannot be removed from these regions. This leads to quality problems during the further processing or finishing of the surface.

An apparatus and a method for machining a strip- or plate-shaped metallic workpiece is known from publication WO 2004/039536 A1 of the generic type. This apparatus is especially suitable both for the deburring and edge radiusing of metallic workpieces and for the removal of oxide layers of cut surfaces and/or cut edges of the workpiece. Provided here in a revolutionary new way is a revolving conveying device provided with at least one brush, the conveying device directing the at least one brush at least approximately linearly past the region of the workpiece to be machined obliquely or transversely to the feed direction of the workpiece. The metallic workpiece is therefore for the first time no longer machined against or in the feed direction of the workpiece but rather obliquely or transversely thereto.

Due to the machining of the workpiece obliquely or transversely to the feed direction of the workpiece, uniform wear of the brush is achieved. This is the case irrespective of the dimensions of the workpiece to be machined. In contrast to the prior art, it is no longer necessary for the brush to be at least as wide as the workpiece to be machined. In addition, an advantage in the case of the publication of the generic type is that the brush, owing to the fact that it travels along the workpiece obliquely or transversely to the feed direction of the workpiece, can penetrate into every recess and can thus remove the oxide layer at all cut surfaces and edges. In addition, this leads to the edges being deburred or radiused.

SUMMARY OF THE INVENTION

The object of the present invention is to provide a fast, simple and cost-effective apparatus for machining strip- or plate-shaped metallic workpieces, in particular for the deburring of edges and for the grinding of surfaces.

Owing to the fact that the machining element is designed as a grinding belt which is directed at least approximately linearly past the region of the workpiece to be machined obliquely or transversely to the feed direction of the workpiece by means of a revolving drive device, the workpiece is machined according to the principle described in WO 2004/039536 A1. This consequently also results in the advantages which result from the machining of a workpiece obliquely or transversely to the feed direction of the same. Therefore, the width of the grinding belt does not have to correspond to the width of the workpiece to be machined. In addition, the grinding belt is worn down uniformly irrespective of the fed workpiece, since not only is merely a certain section of the grinding belt used for the machining of the workpiece, but rather the grinding belt is directed past the workpiece in a machining manner over the entire length that is available for passing the workpiece through.

The grinding belt permits especially preferred machining of the surfaces, that is to say the main surfaces of the strip- or plate-shaped metallic workpieces, such that said surfaces are reliably freed of residues (for example resulting from cutting operations or the like) and therefore no quality problems occur during the further processing or finishing of the metallic workpieces. In addition, the grinding belt machines cut edges and the like in such a way that they are deburred. In particular during plasma cutting, but also during laser cutting or other cutting methods, burrs are produced on the cut edges and cut surfaces, and it is necessary to remove these burrs. Both deburring of the cut edges and cut surfaces and machining of the surfaces of the workpiece can be achieved by the grinding belt in one operation; this preferably with a relatively narrow and thus cost-effective grinding belt which becomes worn uniformly and thus ensures uniform machining of the workpieces.

According to the invention, provision is made for the grinding belt, in the region of the workpiece to be machined, to be in operative connection with the drive device in such a way that the drive device drives the grinding belt. Furthermore, provision is made for the grinding belt and the drive device to be separate from one another at least in a region remote from the workpiece.

Owing to the fact that the grinding belt is in operative connection with the drive device in the region of the workpiece to be machined, the drive device performs a plurality of functions. Firstly, the grinding belt is driven by the drive device; secondly, the drive device supports and guides the grinding belt in the region of the workpiece to be machined. So that the grinding belt can machine the workpiece, certain support of the grinding belt is necessary so that the latter cannot give way upon contact with the workpiece. According to the prior art (see FIG. 1), provision was made for the grinding belt to come into contact with the workpiece at a deflection point, that is to say at a point at which the grinding belt was driven by a drive shaft or was deflected by a deflection roller. In this case, the drive or deflection roller has kept the grinding belt in contact with the workpiece. According to the invention, the drive device now provides for the grinding belt to be given the requisite support during the machining of the workpiece. Owing to the fact that the grinding belt is also driven by the drive device, the feed rates of the grinding belt and of the drive device in the region of the workpiece to be machined are essentially identical, such that no generation of heat or only slight generation of heat takes place between the grinding belt and the drive device.

According to the invention, provision is made for the grinding belt and the drive device to be separate from one another at least in a region remote from the workpiece, that is to say in a region in which the grinding belt does not machine the workpiece. Firstly, this ensures that the grinding belt can be fitted and tensioned independently of the drive device; secondly, different expansions can be compensated for, for example if the drive device has a revolving belt via which the grinding belt is driven. In a configuration of the drive device such that it has a drive shaft and a deflection shaft about which a belt revolves, it has been found in tests that the belt is expanded at different points due to the drive and is compressed at other points. The belt, which can be made of polyurethane for example, compensates for these changes in length. However, the grinding belt does not have an expansion behavior of this kind. An expansion of the grinding belt would lead to tearing of the grinding belt. In addition, an expansion movement of the belt relative to the grinding belt would result in considerable generation of heat on account of the friction forces, this generation of heat having an adverse effect on the functioning of the apparatus.

Owing to the fact that the grinding belt and the drive device revolve independently of one another at least in a region remote from the workpiece, the generation of heat resulting between the grinding belt and the drive device or the belt of the drive device is minimized. The belt can be compressed and expanded without this having an effect on the grinding belt. The expansion behavior of the belt is relatively constant in the region of the workpiece to be machined, such that no appreciable generation of heat on account of the expansion behavior of the belt occurs in this region, in which the grinding belt is in operative connection with the belt and is supported and guided by the latter.

It is not necessary for the grinding belt to revolve independently of or without contact with the drive device in all the regions remote from the workpiece. On the contrary, the expression "a region remote from the workpiece" also refers to the fact that it is only a section (or several sections) of the entire region in which the grinding belt is remote from the workpiece.

It is advantageous if the grinding belt runs at least approximately linearly in a machining region. The machining region in this case will as a rule correspond to the maximum region available for passing the workpiece to be machined through. A linear course of the grinding belt in this region permits uniform machining.

In a constructional configuration of the invention, provision is made for the grinding belt to run at an angle to the machining region in a contact region in front of and/or behind the machining region, and for the grinding belt to be in operative connection with the drive device or a belt of the drive device in the contact region.

Owing to the fact that the grinding belt runs at an angle or obliquely to the machining region in front of and/or behind the machining region and is in operative connection with the belt, the area for driving the grinding belt increases. Due to the oblique position, the belt tensions the grinding belt, such that the latter is advantageously driven and guided. In this case, it has been found in tests that the belt drives the grinding belt better or more effectively in the contact region, that is to say in the oblique position, than on the linear segment of the machining region.

The machining region is preferably formed between a drive shaft and a deflection shaft of the drive device.

Furthermore, in a development of the invention, provision may be made for the belt, in the region of the workpiece to be machined, to be guided via rollers on the side facing away from the workpiece.

By means of the rollers over which the belt runs in the region of the workpiece to be machined, preferably over the entire machining region, the belt is given the requisite support in order to keep the grinding belt in contact with the workpiece.

It is advantageous if the belt is acted upon by a spring force in the region of the workpiece to be machined.

The spring force which acts upon the belt in the region of the workpiece to be machined ensures that the belt presses the grinding belt with constant force onto the workpiece. This leads to an advantageous machining result. Provision may at the same time be made for the belt to be acted upon by a plurality of spring elements which are independent of one another. In the case of a slightly uneven surface of the workpiece, the grinding belt therefore also penetrates into recesses of the workpiece. With a rigid support of the grinding belt, as is normal in the prior art, the grinding belt first of all grinds the "prominences" of the workpiece. It is only when the prominences have been ground down to such an extent that they have reached the level of the "recesses" that the recesses are also ground. When the belt and therefore also the grinding belt are acted upon by a plurality of spring elements which are independent of one another, the grinding belt, after traveling over a prominence, is pressed into the following recess, such that the surface is uniformly ground.

It is especially advantageous if a plurality of rollers are provided, over which the belt is guided, the rollers being acted upon by a respective spring element. Due to this configuration, firstly advantageous guidance, optimized in terms of friction, of the belt is achieved, and secondly the rollers enable the grinding belt to follow the profile of the workpiece.

In a development of the invention, provision may be made for the first and the last roller to be of rigid design, that is to say of unsprung design. This ensures that the grinding belt runs essentially linearly between the first and the last roller and thus in the region of the workpiece to be machined or the machining region. In this case, unevenness in the workpiece can be compensated for by the sprung rollers without the essentially linear course of the grinding belt in the machining region being impaired.

In a further advantageous configuration of the invention, the belt comprises a basic belt on which a comparatively soft, in particular elastic, flexible, layer is arranged. It thus becomes possible to compensate for unevenness, e.g. prominences on the workpiece or thickness tolerances in the flexible region of the elastic layer. If need be, this enables additional spring elements to be completely dispensed with. In order to obtain a cost-effective compact construction of the belt, it is also proposed that the basic belt be coated with a comparatively soft elastic layer. The layer should be elastically flexible so that, after deformations which originate from unevenness or thickness tolerances of a workpiece, return to the original state takes place immediately after the deformation force falls away.

It is advantageous if the belt is beveled on the longitudinal side facing the workpiece to be inserted in order to form an entry region.

An oblique shape of the belt in this region enables the workpiece to be inserted in an especially simple manner without having to fear damage to the grinding belt or tearing of the grinding belt. Alternatively or additionally, provision may be made for the machining unit to be tilted relative to the configuration of an entry region. The machining unit is tilted so that an enlarged entry region can be formed, in such a way that the grinding belt narrows a gap for passing the workpiece through in the feed direction of the workpiece. In this case, it has proved to be sufficient if the machining unit or the grinding belt is inclined relative to the perpendicular by 0.5 to 5 degrees, preferably 2 degrees, with respect to the plane on which the workpiece is passed through. This enables simple insertion of the workpiece to be machined on the one hand, and on the other hand the inclination of the machining unit is not so great that the grinding belt becomes unevenly worn in a noticeable manner.

It is advantageous if the belt of the drive unit is a triple V-belt. This has proved to be especially suitable concerning the durability of the V-belt and the transmission of the drive power to the grinding belt and with regard to the support of the grinding belt. A design of the belt made of polyurethane or a design of the covering layer of the belt made of polyurethane has proved to be especially suitable. The rollers which support the belt can in this case be adapted to the V-belt and can be designed, for example, as a single roller, as double rollers or as triple rollers.

Furthermore, in a constructional configuration of the invention, two machining units may be provided, between which the workpiece can be passed through obliquely or transversely to the revolving direction of the grinding belts in such a way that the grinding belt of each machining unit machines one of the two main surfaces of the workpiece.

It is therefore possible to simultaneously grind and deburr the workpiece on both main surfaces. The workpiece can therefore be machined in one machining operation.

In a further especially preferred configuration of the invention, at least two machining units are provided which are arranged one after the other with regard to the push-through direction of a workpiece to be machined for the machining of a main surface. As a result, different grinding materials, for example, can act sequentially on a main surface. It is conceivable to rough grind using a first machining unit and to carry out corresponding precision grinding using a second machining unit.

For an at least approximately neutral action of force on a workpiece, it is advantageous in this connection if the machining units are directed past a main surface in opposite directions.

However, for the removal of abraded particles on the main surfaces, it has turned out that an identical revolving direction has advantages to the effect that provision has to be made for corresponding removal of abraded particles, e.g. by suction, on only one side.

Furthermore, in a development of the invention, four or more machining units may be provided, in each case two machining units, or their grinding belts, which revolve in opposite directions machining the workpiece at a main surface.

Owing to the fact that each main surface is ground in two opposite directions, an especially preferred grinding result is achieved, and the cut edges are also deburred in an especially preferred manner.

Even in the case of four or more machining units, it is advantageous in a further configuration of the invention if said machining units work in the same direction with respect to a main surface. Thus, as already stated above, central removal of abraded particles on only one side can be realized.

It is advantageous if the machining units are displaceable or adjustable relative to one another. This enables the machining units to be set to the thickness of the workpiece to be machined. Consequently, by displacement of the machining units relative to one another, the gap for passing the workpiece through is reduced. In a configuration of the apparatus according to the invention having only one machining unit, provision may be made for the base on which the workpiece rests and the machining unit to be displaceable relative to one another, such that the gap for passing the workpiece through can be reduced or increased.

It is advantageous if each machining unit has an independent drive, preferably in the form of an electric motor. This has proved to be especially expedient.

BRIEF DESCRIPTION OF THE DRAWINGS

An exemplary embodiment of the invention is shown in principle below with reference to the drawings.

DETAILED DESCRIPTION OF THE INVENTION

Figure 1:
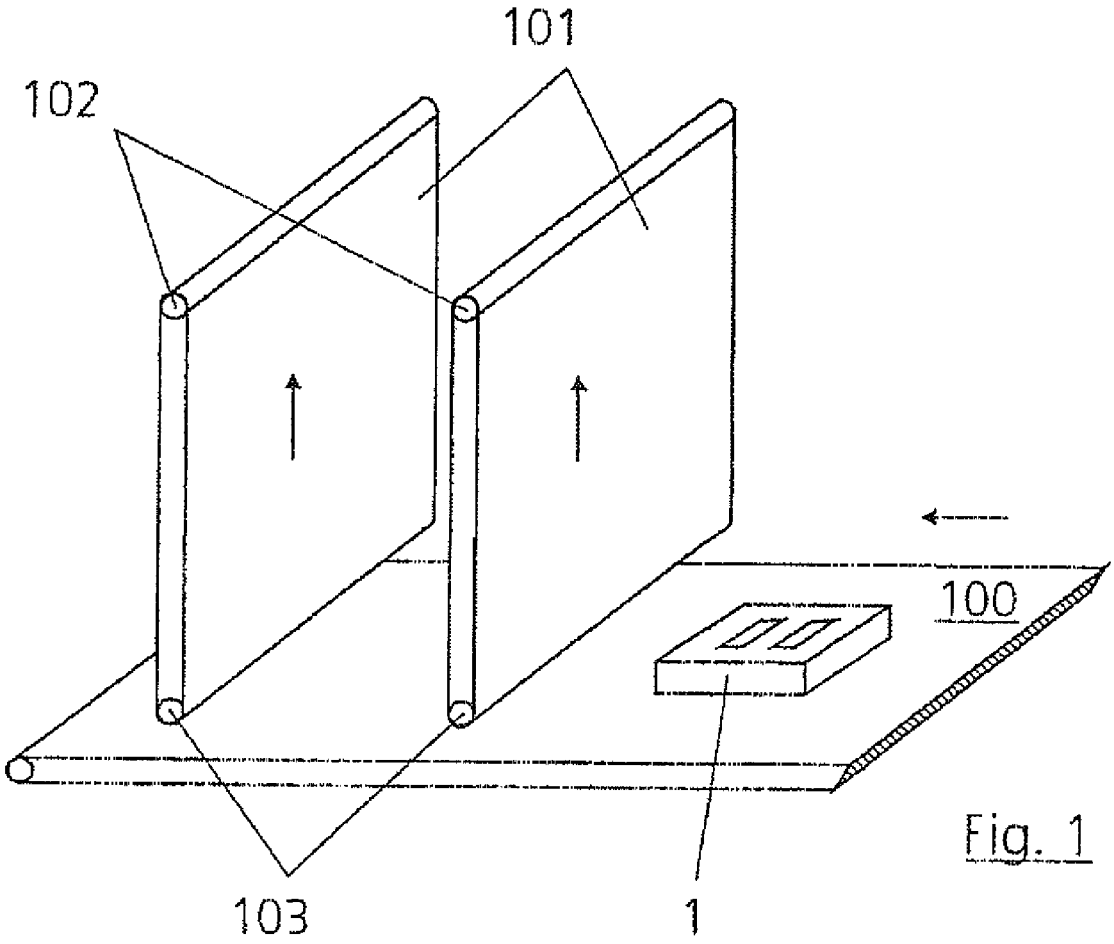
FIG. 1 shows an apparatus according to the prior art.

FIG. 1 shows an apparatus according to the prior art. In this case, a workpiece 1 is placed on a conveyor belt 100 and fed to two grinding belts 101 revolving essentially in the vertical direction. In the region of the workpiece to be machined, that is to say in the region in which the grinding belts 101 come into contact with the workpiece 1, the grinding belts 101 run against the feed direction of the workpiece 1. The grinding belts 101 are driven by a drive shaft 102 and are deflected and supported by a deflection shaft 103 in the region of the workpiece 1 to be machined.

The apparatus according to the invention is shown in FIGS. 2 to 9.

Figure 2:
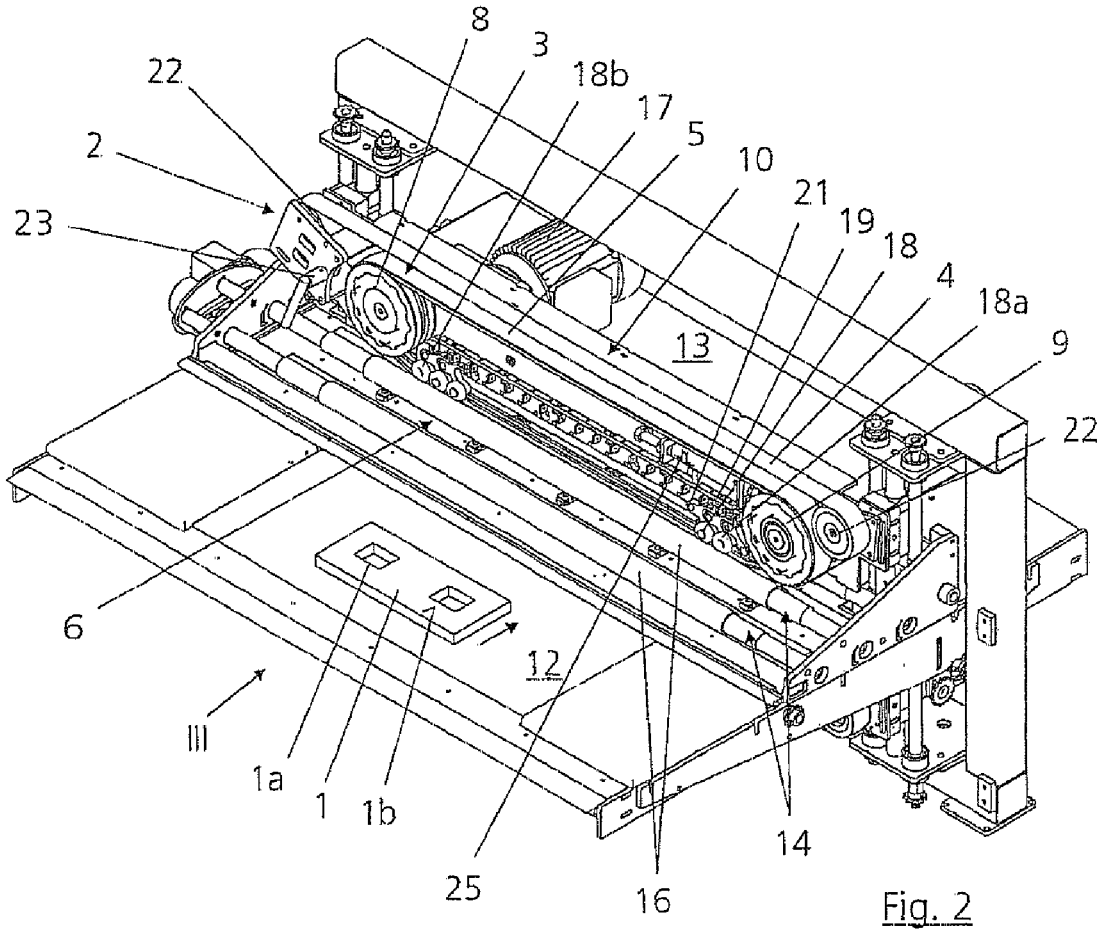
FIG. 2 shows a perspective illustration of the apparatus according to the invention having two machining units.

FIG. 2 shows the apparatus according to the invention for machining a strip- or plate-shaped metallic workpiece 1, the apparatus according to the invention being suitable in a special manner for deburring cut edges 1*a* and for grinding the surfaces 1*b* of the workpiece 1. As can be seen from FIGS. 2 to 4, the apparatus according to the invention shown in the exemplary embodiment has two machining units 2. One of the machining units 2 is shown in detail in FIGS. 5 to 8.

The machining units 2 each have a revolving drive device 3, and these drive devices 3 each direct a machining element, designed as a grinding belt 4, at least approximately linearly past the region of the workpiece 1 to be machined obliquely or transversely to the feed direction of the workpiece 1 (see arrow direction according to FIG. 2).

Figure 6:
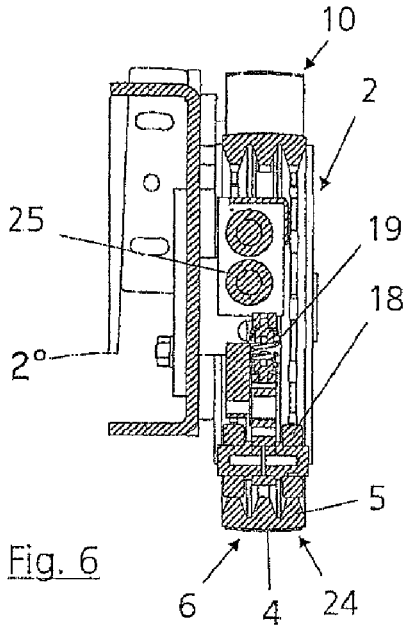
FIG. 6 shows a section through a machining unit of the apparatus according to the invention along line VI-VI in FIG. 5.
Figure 7:
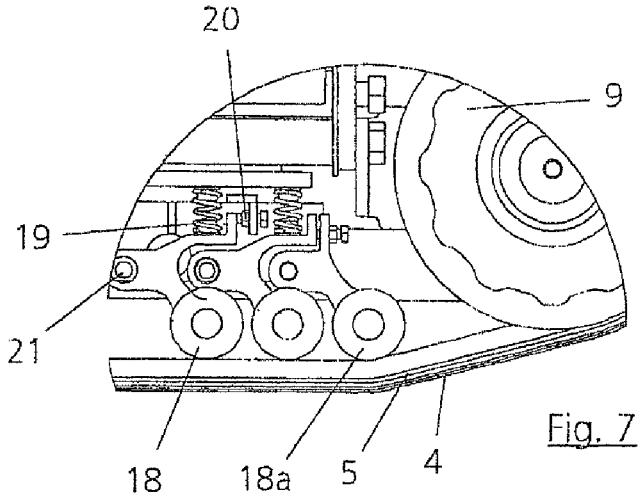
FIG. 7 shows an enlarged illustration of the detail VII shown in FIG. 5.
Figure 8:
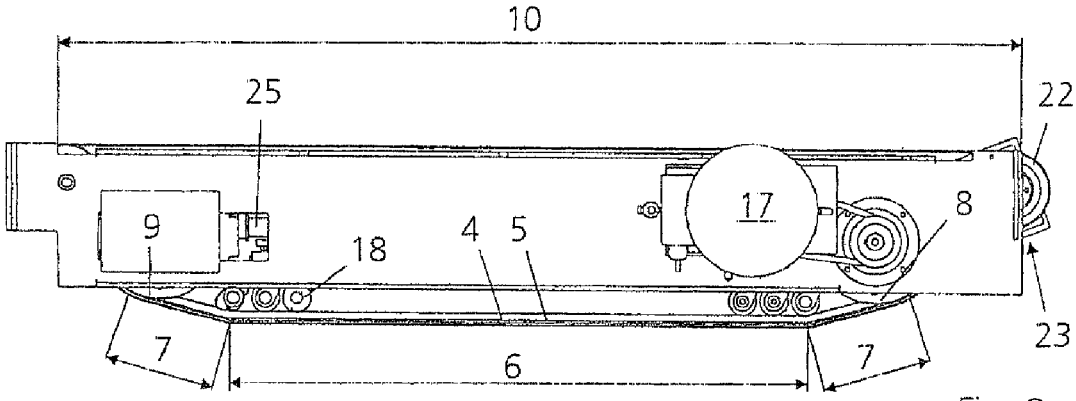
FIG. 8 shows a rear view of the machining unit shown in FIG. 5.
Figure 9:
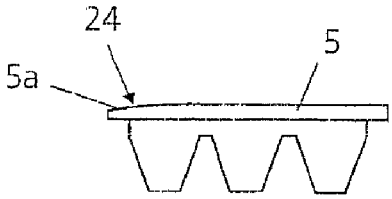
FIG. 9 shows an enlarged sectional illustration of the belt of the drive device.

The drive device 3 has a revolving belt 5, which is designed as a triple V-belt (see FIGS. 6 and 9).

In the region of the workpiece 1 to be machined, the grinding belt 4 is in operative connection with the belt 5 of the drive device 3 in such a way that the belt 5 drives the grinding belt 4. The grinding belt 4 runs at least approximately linearly in a machining region 6. In front of and behind the machining region 6, the grinding belt 4 runs in a contact region 7 at an angle to the machining region 6 and is likewise in operative connection with the belt 5. In this case, the contact regions 7 extend from the machining region 6 up to a region in which the belt is in contact with a drive shaft 8 and a deflection shaft 9, respectively. The grinding belt 4 separates from the belt 5 there, such that the grinding belt 4 and the belt 5 are separate from one another or run separately from one another at least in a region 10 remote from the workpiece 1. The region 10 may in this case be larger than but also smaller than shown in the exemplary embodiment. The separation of the grinding belt 4 from the belt 5 need not necessarily be effected in the region of the drive shaft 8 and/or of the deflection shaft 9. However, separation in this region has turned out to be especially expedient. As can be seen from FIGS. 2 to 4, the workpiece 1 to be machined is passed through or pulled through between the two machining units 2. A lead-through gap 11 can be adapted as a function of the thickness of the workpiece 1 to be machined. To this end, provision is made for the machining units 2 to be adjustable or displaceable relative to one another.

A sheet-metal push-in unit 12 serves to place the workpiece 1 in position. A work tray 13 is provided for the discharge of the workpiece 1. In the exemplary embodiment, the sheet-metal push-in unit 12 and the work tray 13 each have a conveyor belt. Feed units 14 are provided in the region around the machining units 2, as can be seen in particular from FIG. 4. In this case, said feed units 14 each consist of a plurality of conveyor rollers 15 or rolls which are mounted in side edges, running parallel to the feed direction of the workpiece 1, of the sheet-metal push-in unit 12 or work tray 13. The side edges may in this case be designed, for example, as a perforated plate. Owing to the fact that the sheet-metal push-in unit 12 and the work tray 13 are provided with a roller system, the workpiece 1 can be pushed through the apparatus transversely to the machining units 2 in an especially simple manner. A roller system is robust and insusceptible to damage caused by canting of the workpiece 1. In addition, the feed units 14 each have a feed roll 16. In the exemplary embodiment, the feed roll 16 consists of a metallic basic body which is provided with a rubber coating. Uniform and reliable delivery of the workpiece 1 transversely to the revolving directions of the grinding belts 4 is ensured by the feed rolls 16.

In the exemplary embodiment, each drive device 3 has an independent electric motor 17 which drives the belt 5 and thus also the grinding belt 4.

As can be seen in particular from FIGS. 2, 5, 7 and 8, the belt 5 in the machining region 6, which encloses the region of the workpiece 1 to be machined, is guided via rollers 18 on the side facing away from the workpiece 1. The rollers 18 may each be designed as double or triple rollers. A plurality of rollers 18, which are each acted upon by a spring element 19, are provided. Therefore the belt 5 and consequently the grinding belt 4 can be adapted to the profile of the surface 1*b* of the workpiece 1. Provided in the exemplary embodiment (see in particular FIG. 7) is an end stop 20 which limits the movement of the rollers 18 in the direction of the workpiece 1. Deflection of the rollers 18 in a direction away from the workpiece 1 is limited or damped by the spring force of the spring elements 19. The grinding belt 4 and the belt 5 can consequently compensate for unevenness of the workpiece 1 by the rollers 18 being pressed away from the workpiece 1 against the spring force of the spring elements 19. The spring elements 19 ensure that the grinding belt 4 is reliably kept in contact with the workpiece 1 and that an advantageous grinding result is obtained.

The rollers 18 are mounted thus via a bearing point 21. The maximum deflection of the rollers 18 is limited or defined in the process by the end stop 20. Inasmuch as the rollers 18 are not moved against the spring force of the spring elements 19, said rollers 18 form a straight line.

Just on account of the construction of the belt 5, which is preferably made of polyurethane, said belt 5 has certain elasticity and is therefore flexible within certain limits.

In the exemplary embodiment, the first roller 18*a* and the last roller 18*b* are of rigid design. That is to say that, at the entry and the exit, respectively, of the machining region 6, the rollers 18*a*, 18*b* are unsprung, thereby achieving the effect that the grinding belt 4 runs essentially linearly in the machining region 6. This can be seen in particular from FIG. 5 and FIG. 7.

Figure 3:
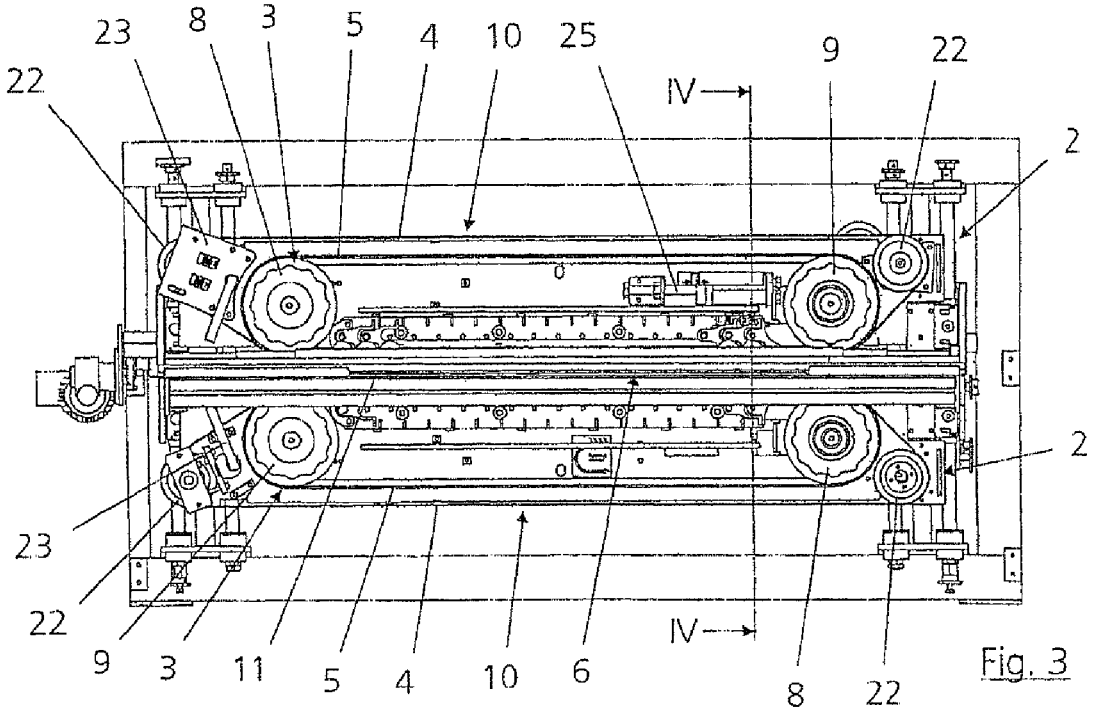
FIG. 3 shows a side view of the apparatus according to the invention in arrow direction III of FIG. 2.
Figure 4:
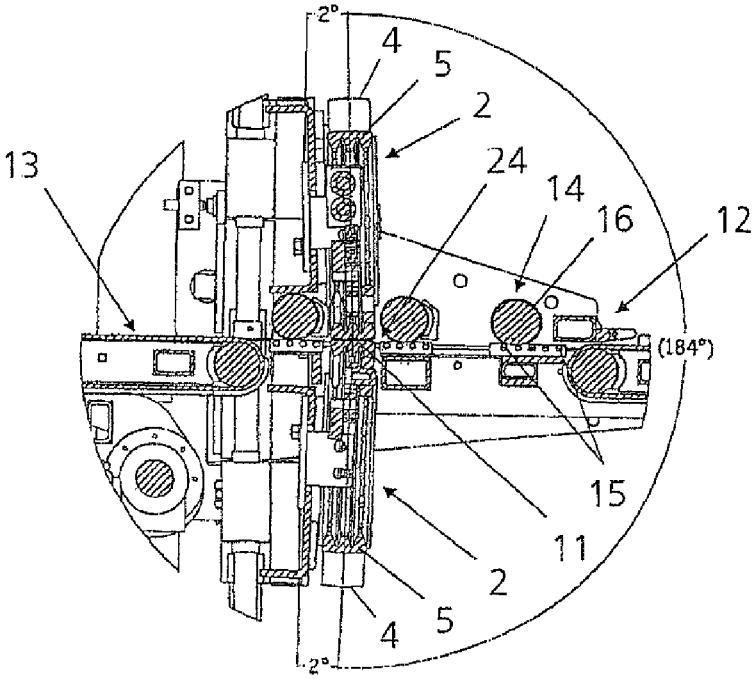
FIG. 4 shows an enlarged sectional illustration along line IV-IV in FIG. 3.
Figure 5:
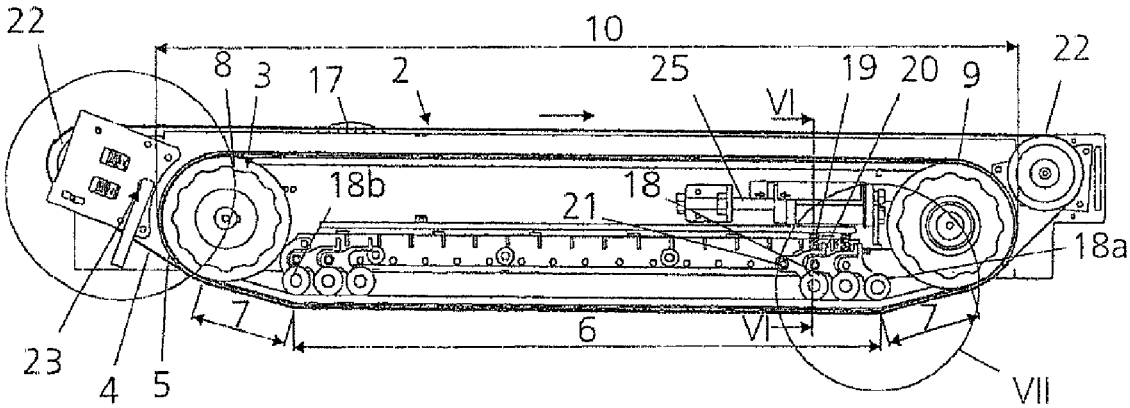
FIG. 5 shows a side view of a machining unit of the apparatus according to the invention.

As can be seen from FIGS. 2, 3 and 5, the grinding belt 4 revolves around two deflection shafts 22, which are independent of the drive shaft 8 and the deflection shaft 9 of the drive device 3. The deflection shafts 22 of the grinding belt 4 are not driven. In the exemplary embodiment, the grinding belt 4 is driven solely by the operative connection between the belt 5 and the grinding belt 4 in the machining region 6 or in the contact regions 7. The grinding belt 4 is tensioned via a quick-tensioning device 23, which to this end has an eccentric (not shown in any more detail). Such quick-tensioning devices 23 are sufficiently known from the general prior art, for which reason they are not dealt with in detail below.

The machining units 2 are tilted in order to form an enlarged entry region 24. To this end, the machining units 2 are each inclined in the exemplary embodiment by 2 degrees relative to a position perpendicular to a machining plane (formed by the sheet-metal push-in unit 12 and the work tray 13). The lead-through gap 11 is therefore narrowed in the feed direction of the workpiece 1 (see FIG. 4).

Furthermore, provision is made in the exemplary embodiment (see FIG. 9) for the belt 5 to be beveled on the longitudinal side facing the workpiece 1 to be inserted, that is to say in the entry region 24. The beveling 5*a* of the belt 5 likewise permits simple insertion of the workpiece 1. For changing the belt 5, which in practice will be relatively rarely, a belt-tensioning device 25 is provided, by means of which the drive shaft 8 and the deflection shaft 9 can be displaced relative to one another, such that the belt 5 can be exchanged in a simple manner.

That surface of the grinding belt 4 which is provided for machining the workpiece 1 may have any desired construction. For example, the grain size or generally the configuration of the surface can be adapted to the desired grinding result. It is essential in this case that the surface of the grinding belt 4 enables edges to be deburred and/or the surface of the workpiece 1 to be ground.

The solution according to the invention can be produced with different machining lengths or widths for the insertion of workpieces 1.

The invention claimed is:

1. An apparatus for machining a flat metallic workpiece, including a machining unit that comprises:

a driven revolving belt oriented to move in a direction obliquely or transversely to a feed direction of the workpiece;

a grinding belt arranged radially outwardly of said revolving belt, said grinding belt being in contact with said and driven by revolving belt in a machining region of the workpiece to be machined and being spaced from said revolving belt in a region remote from the workpiece to be machined; and a spring element acting on a roller for causing the contact between said revolving belt and said grinding belt so that said revolving belt drives said grinding belt at least approximately linearly past the machining region of the workpiece to be machined.

2. The apparatus of claim 1, wherein the grinding belt and the revolving belt run linearly past the machining region.

3. The apparatus of claim 2, wherein the grinding belt and the revolving belt are arranged at an angle to the machining region in at least one contact region upstream and downstream of the machining region, and the grinding belt is in operative connection with the revolving belt in said contact region.

4. The apparatus of claim 1, wherein the revolving belt, at least in the machining region, is guided via rollers on a side thereof facing away from the workpiece.

5. The apparatus of claim 1, further comprising a plurality of spring elements that are independent of one another and act upon the revolving belt.

6. The apparatus of claim 1, wherein the revolving belt comprises a basic belt on which a soft, elastically flexible, layer is arranged.

7. The apparatus of claim 6, wherein the basic belt is coated with the soft layer.

8. The apparatus of claim 5, further comprising a plurality of rollers, which are acted upon by a respective spring element.

9. The apparatus of claim 8, wherein the rollers arranged at the furthest upstream and downstream positions relative to the machining region are not acted upon by a spring element.

10. The apparatus of claim 1, wherein the grinding belt is beveled on a longitudinal side thereof facing the workpiece to be machined in order to form an entry for the workpiece into the machining region.

11. The apparatus of claim 1, wherein the grinding belt is tilted relative to the plane of the workpiece to form an entry for the workpiece into the machining region.

12. The apparatus of claim 1, further comprising a quick-tensioning device for tensioning the grinding belt.

13. The apparatus of claim 12, wherein the quick-tensioning device has an eccentric portion.

14. The apparatus of claim 1, wherein the revolving belt is a triple V-belt.

15. The apparatus of claim 1, wherein the revolving belt, the grinding belt and the spring element define a machining unit, and two machining units are provided, between which the workpiece to be machined is passed through obliquely or transversely to the revolving direction of the grinding belts such that the grinding belt of each machining unit machines one of two main surfaces of the workpiece.

16. The apparatus of claim 1, wherein the revolving belt, the grinding belt and the spring element define a machining unit, and at least two machining units are provided which are arranged one after the other with regard to a push-through entry direction of the workpiece to be machined for the machining of a main surface thereof.

17. The apparatus of claim 15, wherein the grinding belts are directed past a main surface of the workpiece in opposite directions.

18. The apparatus of claim 15, wherein the grinding belts are directed past the main surfaces of the workpiece in the same direction.

19. The apparatus of claim 1, wherein the revolving belt, the grinding belt and the spring element define a machining unit, and four machining units are provided, in each case two machining units which revolve in opposite directions machine the workpiece at a main surface thereof.

20. The apparatus of claim 1, wherein the revolving belt, the grinding belt and the spring element define a machining unit, and four machining units are provided and all machine the workpiece in the same direction with respect to main surfaces thereof.

21. The apparatus of claim 15, wherein the machining units are displaceable or adjustable relative to one another.

22. The apparatus of claim 1, wherein the revolving belt, the grinding belt and the spring element define a machining unit, at least two machining units are provided and each machining unit has an independent drive.

23. The apparatus of claim 22, wherein the drive comprises an electric motor.

24. The apparatus of claim 1, wherein the revolving belt is formed from polyurethane or has a polyurethane covering layer.

* * * * *

UNITED STATES PATENT AND TRADEMARK OFFICE

CERTIFICATE OF CORRECTION

PATENT NO. : 7,614,935 B2
APPLICATION NO. : 12/037427
DATED : November 10, 2009
INVENTOR(S) : Josef Weiland It is certified that error appears in the above-identified patent and that said Letters Patent is hereby corrected as shown below:

Column 1

*Lines 26 and 27*: please change "cuffing" to --cutting--

Column 9

*Line 40*: please delete second occurrence of "said"

*Line 41*: please add --said-- after "driven by"

Signed and Sealed this

Seventh Day of December, 2010

David J. Kappos

David J. Kappos
*Director of the United States Patent and Trademark Office*